US011413871B2

(12) United States Patent
Nakano

(10) Patent No.: US 11,413,871 B2
(45) Date of Patent: Aug. 16, 2022

(54) METHOD OF MANUFACTURING SUBSTRATE WITH RESIN LAYER AND METHOD OF MANUFACTURING LIQUID EJECTION HEAD

(71) Applicant: CANON KABUSHIKI KAISHA, Tokyo (JP)

(72) Inventor: Tomohiko Nakano, Fukushima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 501 days.

(21) Appl. No.: 16/579,636

(22) Filed: Sep. 23, 2019

(65) Prior Publication Data

US 2020/0094557 A1 Mar. 26, 2020

(30) Foreign Application Priority Data

Sep. 26, 2018 (JP) ..... JP2018-180584

(51) Int. Cl.
*B41J 2/16* (2006.01)

(52) U.S. Cl.
CPC ..... *B41J 2/1623* (2013.01); *B41J 2/162* (2013.01)

(58) Field of Classification Search
CPC ..... B41J 2/1632; B41J 2/162; B41J 2/1645; B41J 2/1628; B41J 2/1623; B41J 2/1631
See application file for complete search history.

(56) References Cited

U.S. PATENT DOCUMENTS

| | | | | |
|---|---|---|---|---|
| 9,789,690 | B2 * | 10/2017 | Watanabe | B41J 2/1628 |
| 10,442,202 | B2 * | 10/2019 | Fukumoto | B41J 2/1629 |
| 10,894,409 | B2 * | 1/2021 | Yamamuro | B41J 2/1626 |
| 11,155,083 | B2 * | 10/2021 | Ozaki | B41J 2/1629 |

FOREIGN PATENT DOCUMENTS

| | | |
|---|---|---|
| JP | 2015-104876 A | 6/2015 |
| JP | 2018-83399 A | 5/2018 |

* cited by examiner

*Primary Examiner* — An H Do
(74) *Attorney, Agent, or Firm* — Canon U.S.A., Inc. IP Division

(57) ABSTRACT

In a method of manufacturing a liquid ejection head including transferring a dry film for forming a partial structure of a liquid ejection head from a support to a substrate, the dry film with the support is bonded on a processing surface of the substrate with forming a projection part in which peripheral edges of the dry film and the support protrude further outside than a peripheral edge of the processing surface; the projection part is cut at a cutting position between an outer edge of the projection part and the peripheral edge of the processing surface to form a remaining projection part, and the support is peeled from the substrate with the remaining projection part as a start position to leave the dry film on the processing surface which forms the partial structure of the liquid ejection head.

20 Claims, 6 Drawing Sheets

METHOD OF MANUFACTURING SUBSTRATE WITH RESIN LAYER AND METHOD OF MANUFACTURING LIQUID EJECTION HEAD

BACKGROUND

Field of the Disclosure

The present disclosure relates to a method of manufacturing a substrate with a resin layer and a method of manufacturing a liquid ejection head.

Description of the Related Art

Liquid ejection heads are used as a part of a liquid ejecting apparatus to eject a liquid onto a surface of a recording medium or various members. One example of a liquid ejection head is an ink jet recording head which ejects a liquid in the form of droplets from an ejection orifice using energy applied by an energy-generating element.

A liquid ejection head having a substrate and a flow path forming member provided on the substrate have been known. The flow path forming member forms a flow path for the liquid and, in some cases, an ejection orifice. A supply port is formed in the substrate and the liquid supplied from the supply port to the flow path is ejected from the ejection orifice.

As a method of manufacturing a liquid ejection head, Japanese Patent Application Laid-Open No. 2015-104876 describes a method of transferring a dry film to a substrate and forming a flow path forming member from the transferred dry film. Before being transferred to the substrate, the dry film is supported by a support and the support is peeled from the dry film in a step of transferring the dry film to the substrate. In this manner, the dry film is left on the substrate and then the dry film is further patterned by photolithography or the like to form a flow path forming member.

SUMMARY

A method of manufacturing a substrate with a resin layer, including transferring a dry film for forming a structure from a support to a substrate according to the present invention includes bonding the dry film supported by the support on a processing surface of the substrate, the bonding including forming a projection part, the projection part being a portion of peripheral edges of the dry film and the support which protrude further outside than a peripheral edge of the processing surface, cutting the projection part at a cutting position between an outer edge of the projection part and the peripheral edge of the processing surface and leaving a portion further inside than the cutting position as a remaining projection part, and peeling the support from the substrate with the remaining projection part as a start position, separating the dry film into a first portion of the remaining projection part supported by the support and a second portion bonded to the processing surface, removing the first portion from the substrate along with the support, and leaving the second portion on the processing surface, the second portion forming the structure, in which the cutting position of the projection part is a position where it is possible to separate the first portion and the second portion of the dry film.

In addition, a method of manufacturing a liquid ejection head, including transferring a dry film for forming a partial structure of a liquid ejection head from a support to a substrate according to the present invention includes bonding the dry film supported by the support on a processing surface of the substrate, the bonding including forming a projection part, the projection part being a portion of a peripheral edge of the processing surface, cutting the projection part at a cutting position between an outer edge of the projection part and the peripheral edge of the processing surface and leaving a portion further inside than the cutting position as a remaining projection part, and peeling the support from the substrate with the remaining projection part as a start position, separating the dry film into a first portion of the remaining projection part supported by the support and a second portion bonded to the processing surface, removing the first portion from the substrate along with the support, and leaving the second portion on the processing surface, the second portion forming the partial structure of a liquid ejection head, in which the cutting position of the projection part is a position where it is possible to separate the first portion and the second portion of the dry film.

Further features of the present invention will become apparent from the following description of exemplary embodiments with reference to the attached drawings.

DESCRIPTION OF THE EMBODIMENTS

In a case of forming a flow path forming member by transferring a dry film supported by a support onto a substrate, it is necessary to remove the support from the dry film bonded to the substrate. The support is generally removed from the dry film by peeling; however, problems such as shape deformation of the dry film may occur at the time of peeling of the support and it is necessary to optimize the peeling method. In order to increase the degree of freedom of the peeling method of the support, there is a method of peeling the support after cutting the dry film with the support, which is bonded to the substrate, into a shape following the peripheral edge of the substrate. By doing so, it is possible to facilitate transportation of the substrate up to the support peeling step or to control the action of the support during peeling only within the substrate region, and an effect of optimizing the peeling method is expected.

Figure 3:
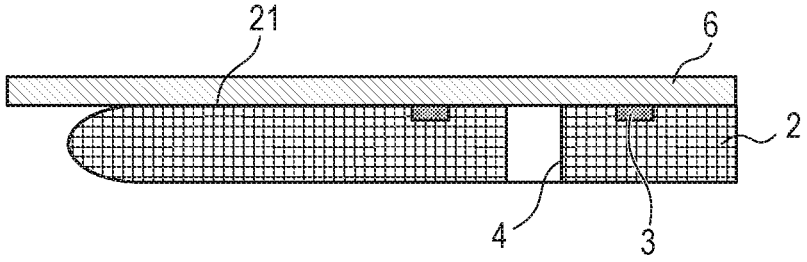
FIG. 3 is a diagram illustrating an example of an end portion of a dry film transferred to a substrate for a liquid ejection head in a state after peeling a support.

However, according to the study of the present disclosure, in the step of cutting the dry film with the support, which is bonded to the substrate, along the peripheral edge of the substrate and then peeling the support, the dry film 6 may remain outside the surface region of the substrate 2 as illustrated in FIG. 3. In particular, in a case where the substrate 2 having a bevel shape at the end portion is used, a tendency for the dry film to be likely to remain on the upper portion of the bevel portion is seen.

The dry film remaining outside the surface region of the substrate is in a state of being easily detached and scattered and is detached and scattered between steps so as to attach to the dry film after transfer, which causes a decrease in yield.

Accordingly, the present disclosure has an object of providing a method of manufacturing a substrate with a resin layer and a method of manufacturing a liquid ejection head in which, when peeling a support from a dry film with the support bonded to a substrate, it is possible to achieve an improvement in yield without the dry film remaining outside the surface region of the substrate.

A method of manufacturing a substrate with a resin layer and a method of manufacturing a liquid ejection head according to the present invention have steps of transferring a dry film for forming a partial structure which is a part of the structure of a liquid ejection head to a substrate for a liquid ejection head.

Examples of the structure formed on the substrate using the substrate with a resin layer include a part of the structure of the liquid ejection head and a part of the structure of a micromachine such as an acceleration sensor.

Examples of a part of the structure of the liquid ejection head, that is, a partial structure include at least a part of a flow path forming member which forms a flow path for supplying a liquid to an ejection orifice for ejecting the liquid. Depending on the desired structure of the liquid ejection head, the flow path forming member is provided with a flow path and an ejection orifice communicating with the flow path. The substrate to which the dry film is transferred functions as a base of the flow path forming member and, depending on the desired structure of the liquid ejection head, an energy-generating element and a wiring for driving the element are provided on the substrate.

The lamination of the dry film on the substrate is performed by laminating, bonding, and transferring the dry film supported by the support onto the substrate surface, and then peeling the support from the dry film on the substrate.

The dry film is formed of a material which has adhesiveness with which bonding to a substrate is possible and which is able to be processed into a structure. Examples of forming materials of a dry film include various photosensitive materials and the like for processing by photolithography. The dry film maintains a continuous layer state on the support due to aggregating force of the material forming the dry film.

In the bonding step, the dry film with the support is bonded such that the dry film covers the processing surface of the substrate forming the structure and the peripheral edge of the dry film with the support forms a projection part which protrudes further than the peripheral edge of the processing surface of the substrate. In the cutting step, the projection part of the dry film with the support is cut at a cutting position between the outer edge thereof and the peripheral edge of the processing surface of the substrate. In the projection part formed at the time of bonding to the substrate, due to the cutting, a portion outside the cutting position is removed and a portion inside the cutting position remains as a remaining projection part. The end surface of the remaining projection part produced by this cutting is formed of the end surface of the two layers of the dry film and the support.

As the cutting position of the projection part, a position is selected which enables separation of the first portion and the second portion described above of the dry film in the peeling step.

The peeling of the support from the substrate in the peeling step is started from the remaining projection part of the dry film with the support. At this time, by setting the cutting position of the projection part to the position described above, the separation of the first portion and the second portion described above of the dry film occurs. Then, the first portion is removed from the substrate together with the support and the second portion remains in a state of covering the processing surface of the substrate, and the transfer of the dry film is completed. The second portion forms the structure.

Desired processing is performed on the dry film transferred to the processing surface of the substrate to form a structure such as a partial structure of the liquid ejection head.

A description will be given below of an example of an aspect for carrying out the present invention by a method of manufacturing a liquid ejection head using a method of manufacturing a substrate with a resin layer.

<Embodiment>

Figure 1A:
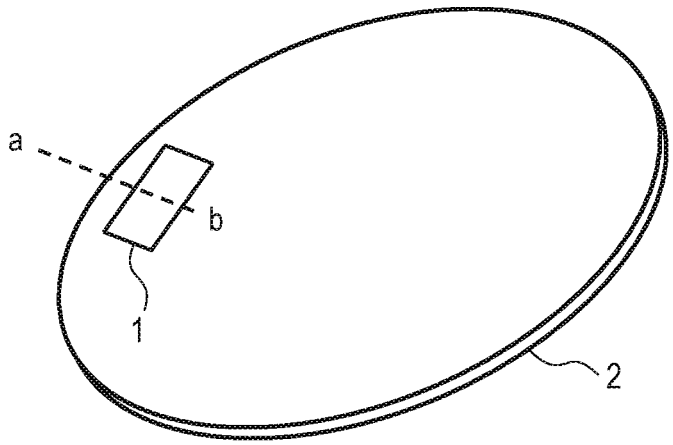
FIG. 1A and FIG. 1B are diagrams illustrating an example of a state in which a large number of liquid ejection units are formed on a common substrate.
Figure 1B:
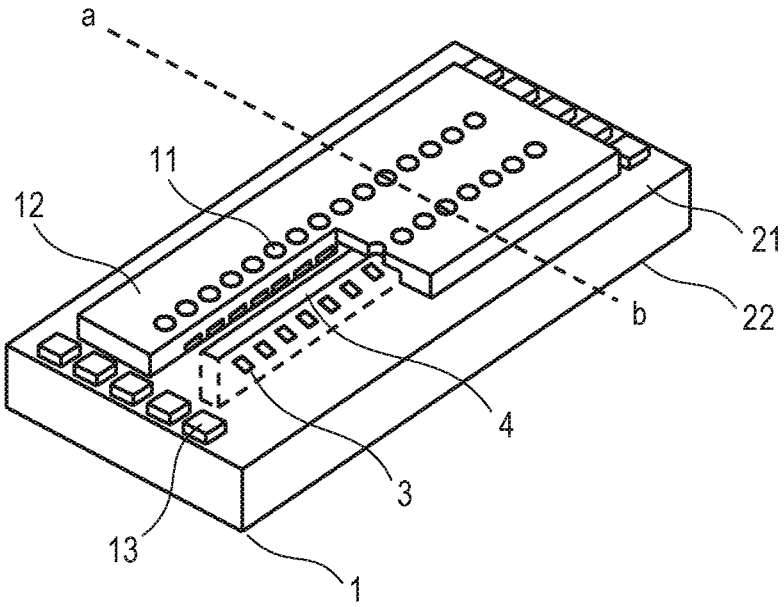

FIG. 1A and FIG. 1B illustrate an example of a liquid ejection head to which it is possible to apply the method of manufacturing a liquid ejection head according to the present invention.

A liquid ejection unit 1 is formed in a chip shape on a substrate 2 which is a common substrate for each liquid ejection unit 1. The liquid ejection unit 1 is cut out from the substrate 2 as a plurality of liquid ejection heads. A large number of liquid ejection units 1 are arranged in the substrate 2 and the number and arrangement of the liquid ejection units 1 are not particularly limited. For example, the arrangement number and arrangement form of the liquid ejection units may be selected in consideration of the shape and size of each liquid ejection unit, the utilization efficiency of the substrate 2, the cutting efficiency of each liquid ejection unit, and the like.

The substrate 2 is formed of a silicon wafer or the like, and, in general, the end portion is processed into a bevel shape in order to suppress the generation of dust from the end portion of the substrate. It is possible to process and form this bevel shape by chamfering the corners of the end portion of the substrate. Examples of this method include polishing, etching, and the like.

An energy-generating element 3 is formed on a first surface 21 of the substrate 2. Examples of the energy-generating element 3 include a heating resistor and a piezoelectric element, and the energy-generating element 3 may be formed with the whole surface in contact with the first surface 21 of the substrate or may be formed with a shape or structure partially in contact with the first surface 21 of the substrate. In addition, a bump 13 is formed on the first surface 21 side of the substrate 2, and the energy-generating element 3 is driven by the power supplied from the outside of the substrate 2 through the bump 13. A supply port 4 penetrating the first surface 21 and a second surface 22 which is the back surface thereof is formed in the substrate 2. Energy is applied to the liquid supplied from the supply port 4 by the driven energy-generating element 3 and the liquid is ejected from an ejection orifice 11 formed in the flow path forming member 12.

Next, a description will be given of an embodiment of a method of manufacturing a liquid ejection head according to the present invention. FIG. 2A to FIG. 2I are partial crosssectional views corresponding to the portion illustrated by a-b of the liquid ejection unit 1 including the end portion of the substrate 2 illustrated in FIG. 1A and FIG. 1B.

Figure 2A:
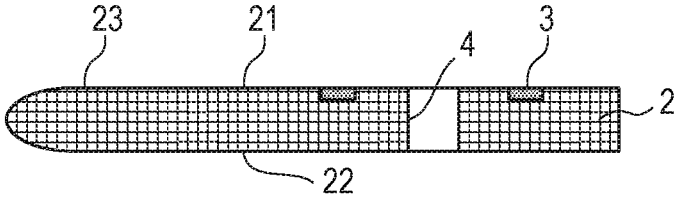
FIG. 2A, FIG. 2B, FIG. 2C, FIG. 2D, FIG. 2E, FIG. 2F, FIG. 2G, FIG. 2H and FIG. 2I are step diagrams illustrating an example of a method of manufacturing a liquid ejection head according to the present invention.

First, as illustrated in FIG. 2A, the substrate 2 is prepared which has the energy-generating element 3 in the first surface 21 side as a processing surface where a flow-path forming member is formed. The shape forming the outer edge of the substrate 2 is not particularly limited and may be circular as illustrated in FIG. 1A or may be a shape other than circular. The shape of an end portion 23 is also not particularly limited. Here, the end portion 23 with a bevel shape is illustrated. The processing surface of the substrate is formed of the first surface 21 of the substrate formed in a planar shape, and, in a case of a substrate having an end portion with a bevel shape, a portion where the planar first surface and the beveled curved surface intersect is the peripheral edge of the first surface as the processing surface. In a case where the substrate has an end surface in the direction intersecting with the planar first surface as an end portion, the corner where these surfaces intersect becomes the peripheral edge of the first surface as the processing surface.

The energy-generating element 3 may be covered with a protective film (not illustrated) formed of SiN, $SiO_2$, or the like. The supply port 4 is formed in the substrate 2 and the supply port 4 is opened to communicate with the first surface 21 and the second surface 22 of the substrate 2, and it is possible to supply liquid from the second surface 22 side to the first surface 21 side through the supply port 4. Examples of the method of forming the supply port 4 include laser processing, reactive ion etching, sand blasting, wet etching, and the like.

Figure 2B:
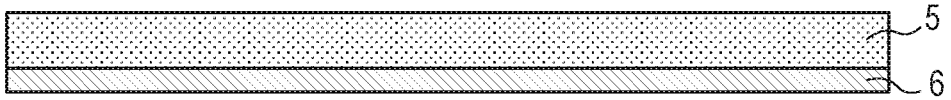

Next, as illustrated in FIG. 2B, the dry film 6 being supported by the support 5 is prepared. Examples of the support 5 include films formed of various materials, glass plates, silicon plates, and the like. The support is preferably a film from the viewpoint of operability in cutting and peeling. Examples of the film for the support include a support formed of a resin such as PET (polyethylene terephthalate), polyimide, polyamide, polyaramid, Teflon (registered trademark), polyvinyl alcohol, polycarbonate, polymethylpentene, cycloolefin polymer, and the like. In order to facilitate peeling of the support 5 from the dry film 6, a release treatment may be performed on the dry film forming surface of the support. The thickness of the film is not particularly limited and may be set so that the film functions as a support of the dry film.

The dry film 6 is formed of a photosensitive resin layer formed using a photosensitive resin composition.

Examples of a resin component of the photosensitive resin composition include an epoxy resin, an acrylic resin, a urethane resin, and the like. Examples of the epoxy resin include bisphenol A-type, cresol novolac-type, and alicyclic epoxy resins, examples of the acrylic resins include polymethyl methacrylate, and examples of the urethane resins include polyurethane, and the like.

The photosensitivity of the dry film may be negative or positive and may be selected according to the method of forming the flow path forming member. In addition, the dry film may be a chemically amplified type having a thermosetting property.

As the dry film, it is possible to use a commercially available dry film, a dry film formed on a support using a photosensitive resin composition, and the like.

The method of forming the dry film on the support is not particularly limited, but it is possible to use a well-known method. Examples thereof include a method of applying a coating liquid, which is obtained by dissolving a photosensitive resin composition in a solvent, to the support and carrying out drying to form the dry film. As a solvent for coating liquid preparation, it is possible to use a well-known solvent, for example, PGMEA (propylene glycol methyl ether acetate), cyclohexanone, methyl ethyl ketone, xylene, and the like. It is possible to use a spin coating method, a slit coating method, and the like for coating a coating liquid on the support. In addition, the size of the dry film is selected so as to be able to cover the processing surface of the substrate 2 for forming the flow path forming member and to form the remaining projection part for peeling the support by a step described below.

The photosensitive resin composition may include a photoacid generator. As the photoacid generator, it is possible to use triarylsulfonium salts, onium salts, and the like. One or more types thereof may be used, or two or more types may be used in combination.

Figure 2C:
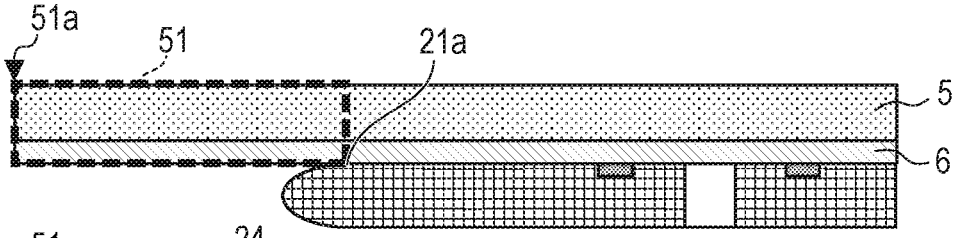

Next, as illustrated in FIG. 2C, the dry film 6 with the support 5 is bonded and transferred to the first surface 21 of the substrate 2 on which the supply port 4 is formed, and a dry film layer for forming a portion of a flow path forming member 12 is formed on the substrate 2. By bonding the dry film 6 with the support 5 and the substrate 2, a projection part 51 protruding outward from the peripheral edge of the first surface 21 is formed. A pressure treatment and/or a heat treatment may be used to bond the dry film 6 and the substrate 2 as necessary.

Figure 2D:
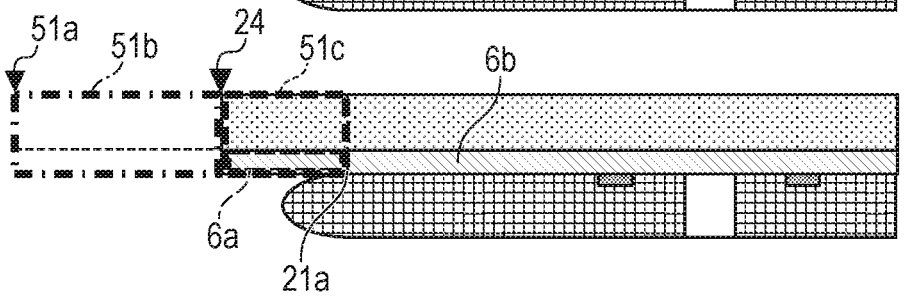

Next, as illustrated in FIG. 2D, the dry film 6 with the support 5 is cut at a cutting position 24 between a peripheral edge 21*a* of the first surface 21 as the processing surface of the substrate 2 for forming the flow path forming member and an outer edge 51*a* of the projection part 51. The distance from the peripheral edge 21*a* of the first surface 21 of the substrate 2 to the cutting position 24 is set such that the dry film 6 is able to be separated into a first portion 6*a* and a second portion 6*b* by peeling the support 5 from a remaining projection part 51*c* which is generated by the cutting. The cutting of the dry film 6 together with the support 5 at the cutting position 24 removes a region 51*b* of the projection part 51 outside the cutting position 24, and leaves the remaining projection part 51*c* inside the cutting position 24. When the support 5 is peeled from the substrate 2 with the remaining projection part 51*c* as the start position, the first portion 6*a* and the second portion 6*b* of the dry film are separated, and the first portion 6*a* is removed from the substrate 2 along with the support 5 and the second portion 6*b* remains on the first surface 21 of the substrate 2. That is, setting the cutting position 24 as described above makes it possible to perform the separation of the first portion 6*a* and the second portion 6*b* of the dry film on the peripheral edge 21*a* of the first surface 21 of the substrate 2. The second portion 6*b* of the dry film forms the structure.

The distance (shortest distance) from the peripheral edge 21*a* of the first surface 21 of the substrate 2 to the cutting position 24 is preferably determined by the material of the dry film 6 and the resistance to tearing due to the thickness thereof. That is, the distance is preferably determined by the aggregating force (referred to below as dry film aggregating force) and the holding force according to the adhesion and the adhesion area of the interface between the support 5 and the dry film 6 (referred to below as interfacial holding force).

The thickness of the dry film may be selected according to the structure and the like of the target structure, and is able to be selected from a range of 30 μm or less.

It is possible to measure the aggregating force and interfacial holding force of the dry film by a known method by preparing a test sample. For example, it is possible to measure the aggregating force by a tensile test of a dry film or the like and to measure the interfacial holding force by a tape peel test or the like.

Figure 2E:
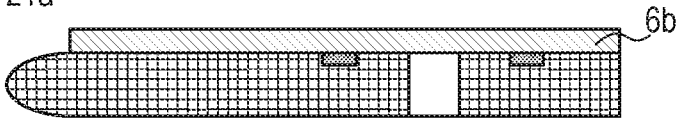

In a case where the aggregating force and interfacial holding force are not measured, a cutting position where no dry film remains outside the substrate region may be found by preparing the required number of test samples with different cutting positions and confirming in advance the degree of remaining dry film outside the substrate region when removing the support from the substrate. When peeling the support 5 in a subsequent step, in a case where the dry film aggregating force is smaller than the interfacial holding force, as illustrated in FIG. 2E, the first portion 6*a* of the dry film outside the first surface 21 of the substrate 2 is peeled in a state of being adhered to the support 5 side. In a case where the dry film aggregating force is larger than the interfacial holding force, the portion of the dry film outside the first surface 21 of the substrate 2 remains on the substrate 2 side as illustrated in FIG. 3. This remaining dry film is in a state of being easily detached and scattered, and, if the dry film attaches to the surface of the flow path forming member in a subsequent step, this causes a decrease in yield. The cutting position 24 is thus set such that it is possible to obtain the peeling state as illustrated in FIG. 2E.

Here, the material and thickness of the dry film 6 are appropriately selected according to the structure and characteristics of the liquid ejection head to be produced, and the adhesion between the support 5 and the dry film 6 is determined by the material of the dry film, the type of the support, and the like. On the other hand, since it is possible to determine the adhesion area of the support 5 and the dry film 6 according to the position to be cut, it is possible to change the degree of interfacial holding force by adjusting the position to be cut. Considering the influence on the substrate transport up to the peeling step, when the cutting position 24 is X and the peripheral edge 21*a* of the first surface 21 of the substrate 2 is at a position 0 mm, adjustment is desirable in accordance with various conditions such as aggregating force, interfacial holding force, and the like of the dry film in the range of 0 mm<X<15 mm. In a case of cutting at a position exceeding 15 mm, there is a concern that the substrate may be damaged by coming into contact with the transport unit or various units on the flow line of the substrate at the time of substrate transport to a subsequent step.

Examples of the method of cutting the projection part 51 formed of the dry film 6 with the support 5 at the cutting position 24 include cutting with a cutter, dissolution with a laser, and the like. In addition, depending on the type of the support 5, a method of applying heat and cutting is preferable.

Figure 4A:
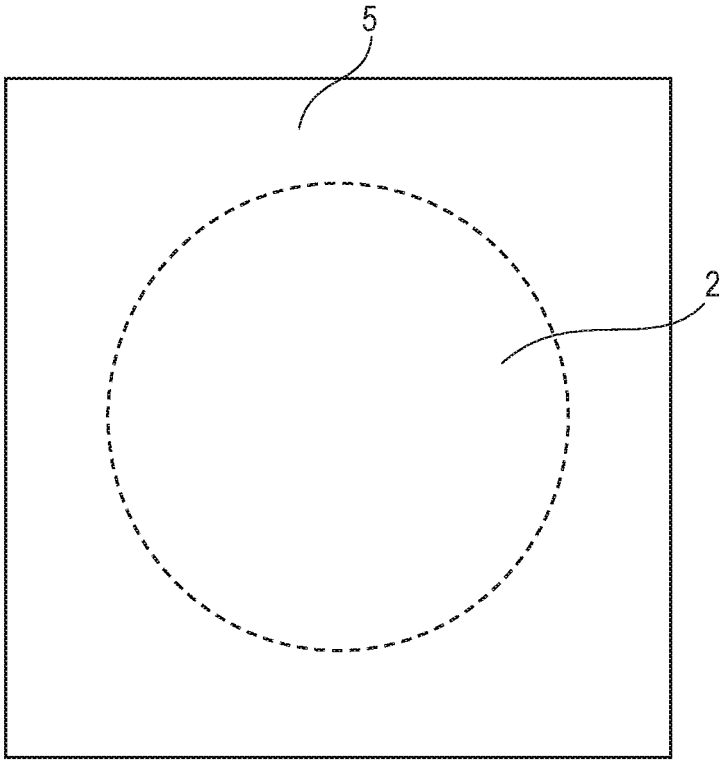
FIG. 4A and FIG. 4B are diagrams illustrating an example of a dry film supported by a sheet-like support 5 in a state of being bonded to a substrate with a planar shape which is a circle and in a state after being cut at a cut position.
Figure 4B:
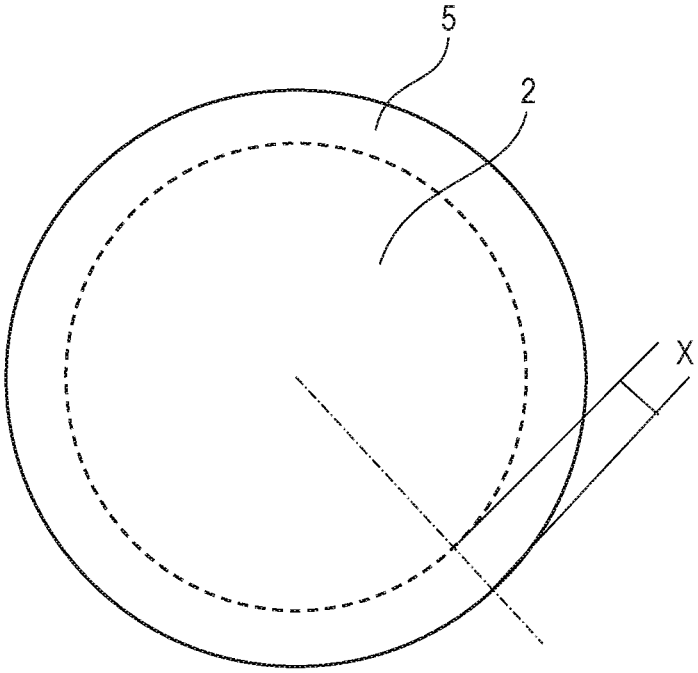

FIG. 4A and FIG. 4B illustrate an example of a state in which the dry film supported by the sheet-like support 5 is bonded to the substrate 2 with a planar shape which is a circle and a state after being cut at the cutting position.

Thereafter, the support 5 is peeled from the substrate 2 with the remaining projection part 51*c* as the peeling start position, and the state illustrated in FIG. 2E is obtained. In a case where a film is used as a support, it is desirable to perform cutting or peeling in an appropriate temperature environment in consideration of the viscoelastic property of the film. At the time of cutting, it is desirable to cut the entire periphery in order not to leave the dry film in the entire region of the outer periphery of the substrate.

Figure 5:
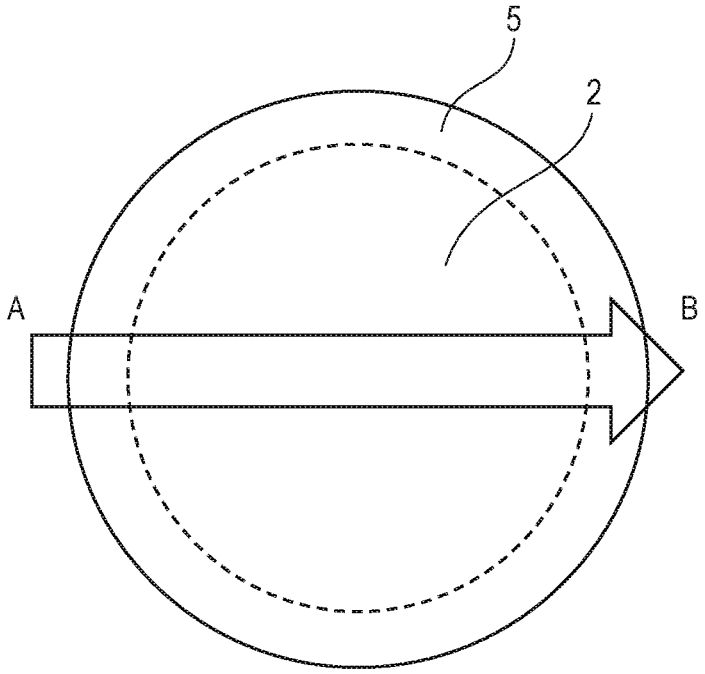
FIG. 5 is a view illustrating an example of the peeling direction of the support from the substrate.

The peeling method is generally a method in which the end portion of the support is held, the held location is set as the peeling start position, and peeling is carried out linearly, as in a case where a tape is peeled, from the end portion as the peeling start position in a direction toward an end portion opposing the end portion with the peeling direction as one direction. An example of the peeling direction of the support is illustrated as a direction from A to B in FIG. 5. Point A in FIG. 5 is the peeling start position and point B is the peeling end position. When the support 5 is peeled linearly from the peeling start position A in the arrow direction, separation of the dry film occurs at the peripheral edge 21*a* of the first surface 21 of the substrate 2 described above at the peeling start position. The separation at the peripheral edge 21*a* of the first surface 21 of the substrate 2 at the peeling start position A also occurs on the side surface of the substrate 2 with respect to the arrow direction as the peeling progresses, and ends at the peeling end position B. In this manner, it is possible to achieve the desired removal of the remaining projection part 51*c* in the entire peripheral edge 21*a* of the first surface 21 of the substrate 2.

The temperature, angle, and speed at the time of peeling have a relationship to the dry film aggregating force, and it is desirable to select values for each item with which it is possible to control the dry film aggregating force to be small. In detail, it is desirable that the temperature range of the environment during peeling of the support is 10° C. or more and 100° C. or less, the peeling angle is 30° or more and 90° or less, and the peeling speed is 1 mm/sec or more.

Figure 6:
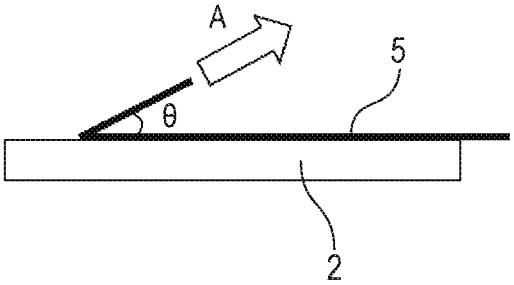
FIG. 6 is a view for illustrating a peeling angle when peeling the support from the substrate.

As illustrated in FIG. 6, the peeling angle is an angle θ between the pulling direction of the fold of the support 5 indicated by the arrow and the first surface (plane) 21*a* of the substrate 2 when pulling the support 5 on the substrate 2 in the peeling direction.

Figure 2F:
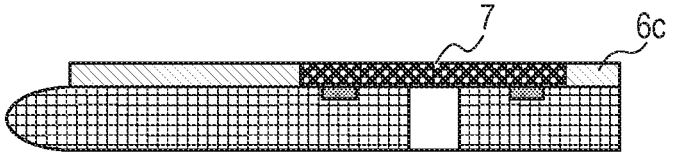

Next, as illustrated in FIG. 2F, a latent image of a pattern 7 used as a flow path is formed in the dry film 6 by exposure. In the present embodiment, the dry film 6 has negative photosensitivity and the pattern exposure produces a cured portion 6*c* cured by exposure and the pattern 7 which becomes a flow path remaining in an uncured state without being exposed.

Figure 2G:
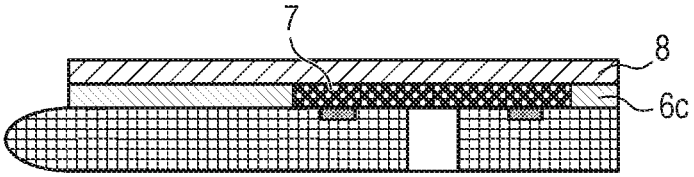
Figure 2H:
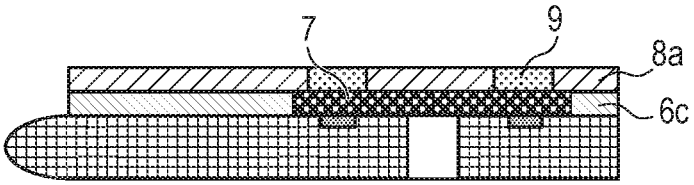

Next, as illustrated in FIG. 2G, a photosensitive resin layer 8 which is a part of the flow path forming member 12 forming the ejection orifice is laminated, and, as illustrated in FIG. 2H, a latent image of a pattern 9 to be the ejection orifice 11 is formed by exposure. A photosensitive resin composition similar to the dry film 6 is used to form the photosensitive resin layer 8 and it is preferable to use a composition adjusted by changing the sensitivity to the dry film 6 by adding a photoacid generator or the like, changing the photosensitive wavelength range, and the like. In the present embodiment, the photosensitive resin layer 8 for forming the ejection orifice has negative photosensitivity, and, through the pattern exposure, a cured portion 8*a* cured by exposure and the pattern 9, which is to be the ejection orifice remaining in an uncured state without being exposed, are generated.

Figure 2I:
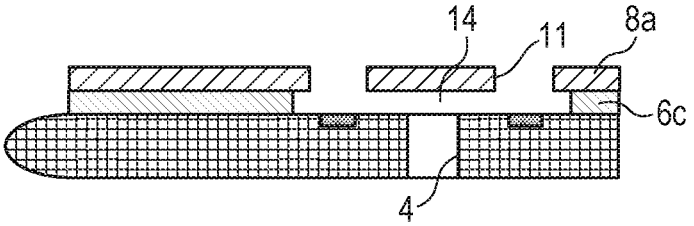

Next, as illustrated in FIG. 2I, by developing the latent image of the pattern 7 to be the flow path and the latent image of the pattern 9 to be the ejection orifice, a flow path 14 and the ejection orifice 11 are formed.

Finally, a liquid ejection head is formed by cutting out the liquid ejection unit 1 from the substrate 2 and performing electrical connection and the like.

In the example illustrated in FIG. 2A to FIG. 2I, the flow path forming member is formed using the substrate 2 provided with the supply port 4 in advance, but the timing of forming the supply port 4 in the substrate 2 is not limited thereto and the forming may be performed during the forming of the flow path forming member or after the forming of the flow path forming member is completed.

In the above, a description was given of a case of using a dry film having negative photosensitivity as the dry film 6, but a partial structure of the liquid ejection head may be formed according to the method described in Japanese Patent Application Laid-Open No. 2018-83399 using a positive dry film.

EXAMPLES

A more detailed description will be given below of the present invention. The results of each Example are summarized in Table 1 and Table 2. The evaluation in Table 1 and Table 2 was performed according to the following criteria.

C: A case where the remaining dry film exceeds the outer edge of the bevel.

B: The dry film remains, but only in the region between the peripheral edge and the outer edge.

A: No dry film remains.

Example 1

First, as illustrated in FIG. 2A, the substrate 2 was prepared having the energy-generating element 3 formed of TaSiN on the first surface 21 side and the end portion 23 formed in a bevel shape. A silicon (100) substrate is used as the substrate 2 and the substrate 2 has a protective film (not illustrated) formed of SiN. The supply port 4 is formed in the substrate 2 and the supply port 4 is opened in the first surface 21 of the substrate 2. The supply port 4 was formed by the Bosch process using the RIE (reactive ion etching) method.

Next, as illustrated in FIG. 2B, the support 5 and the dry film 6 (first dry film) supported by the support 5 were prepared. The support 5 was a PET film with a thickness of 100 μm and the dry film forming surface thereof was subjected to a release treatment. Next, a solution in which an epoxy resin (manufactured by Dainippon Ink, trade name: N-695) and a photoacid generator (manufactured by San-Apro, trade name: CPI-210S) were dissolved in PGMEA was coated on the dry film forming surface of the support 5. The result was dried at 100° C. in an oven to form the dry film 6.

Next, as illustrated in FIG. 2C, the dry film 6 supported by the support 5 is bonded and transferred to the first surface 21 of the substrate 2 on which the supply port 4 is formed, and thereby a dry film layer which is a part of the flow path forming member 12 was formed. The bonding was performed by a roll type laminator (manufactured by Takatori Corp., trade name; VTM-200). The thickness of the dry film 6 after bonding was 15 μm.

Next, as illustrated in FIG. 2D, the support 5 and the dry film 6 were cut. The cutting was performed at a position 10 mm outward from the peripheral edge 21*a* of the first surface of the substrate. A stainless steel cutter was used for cutting in an environment of 25° C.

Next, as illustrated in FIG. 2E, the support 5 was peeled from the dry film 6 with the remaining projection part 51*c* as a peeling start position in a 25° C. environment. The peeling was performed at an angle of 30° at 10 mm/sec. At this time, no dry film remained outside the region of the first surface of the substrate.

Next, as illustrated in FIG. 2F, the dry film 6 was exposed to light with an exposure wavelength of 365 nm at an exposure amount of 5000 J/m$^2$ using an exposure apparatus (manufactured by Canon Inc., trade name; FPA-3000i5+). Thereafter, baking was performed at 50° C. for 5 minutes to form the pattern 7 to be a flow path.

Next, as illustrated in FIG. 2G, the photosensitive resin layer 8 to be a part of the flow path forming member 12 was formed by transferring a dry film (second dry film). The second dry film was manufactured by coating a coating solution in which an epoxy resin (manufactured by Japan Epoxy Resin, trade name: 157S70) and a photoacid generator (manufactured by San Apro, trade name: LW-S1) were dissolved in PGMEA and which has a sensitivity different from that of the dry film 6 on a second support, and carrying out drying. This dry film was bonded to the processing surface formed of the flow path pattern 7 and the cured portion 6*c* using a roll type laminator. The thickness of the photosensitive resin layer 8 after bonding was 5 μm. Also here, at the time of cutting the support and the dry film, cutting was performed at a position 10 mm outward from the peripheral edge 21*a* of the first surface 21 of the substrate 2 and the support was peeled. At this time, no dry film remained outside the region of the first surface of the substrate 2. The pattern 9 to be the ejection orifice illustrated in FIG. 2H was formed by pattern exposure using an exposure apparatus (manufactured by Canon Inc., trade name; FPA-3000i5 +). Thereafter, baking was performed at 90° C. for 5 minutes to form the pattern 9 to be the ejection orifice.

Next, as illustrated in FIG. 2I, by immersing in PGMEA, the pattern 7 which is the flow path and the pattern 9 which is the ejection orifice were developed and a flow path forming member having the flow path 14 and the ejection orifice 11 was formed.

Finally, the shape of a liquid ejection unit was cut out from the substrate 2, electrical connection and the like were performed, and a liquid ejection head was manufactured. The liquid ejection head was observed and it was confirmed that there were no defects.

Example 2

In the present Example, since FIG. 2A to FIG. 2C are the same as in Example 1, detailed description thereof will be omitted.

Next, as illustrated in FIG. 2D, the support 5 and the dry film 6 were cut. The cutting was performed at a position 8 mm outward from the peripheral edge 21*a* of the first surface of the substrate 2. A stainless steel cutter was used for cutting in an environment of 25° C.

Next, as illustrated in FIG. 2E, the support 5 was peeled from the dry film 6 in a 25° C. environment. Peeling was performed at an angle of 30° at 10 mm/sec. At this time, no dry film remained outside the region of the first surface 21 of the substrate 2.

Since FIG. 2F to FIG. 2I are the same as in Example 1, detailed description thereof will be omitted. Finally, the shape of a liquid ejection unit was cut out from the substrate 2, electrical connection and the like were performed, and a liquid ejection head was manufactured. The liquid ejection head was observed and it was confirmed that there were no defects.

Comparative Example 1

In the present Comparative Example, since FIG. 2A to FIG. 2C are the same as in Example 1, detailed description thereof will be omitted.

Next, as illustrated in FIG. 2D, the support 5 and the dry film 6 were cut. The cutting was performed at a position 7 mm outward from the peripheral edge 21*a* of the first surface of the substrate 2. A stainless steel cutter was used for cutting in an environment of 25° C.

Next, as illustrated in FIG. 2E, the support 5 was peeled from the dry film 6 in a 25° C. environment. Peeling was performed at an angle of 30° at 10 mm/sec. At this time, the remaining dry film was observed in the region which is approximately 10% of the periphery of the substrate outside the region of the first surface of the substrate 2.

Since FIG. 2F to FIG. 2I are the same as in Example 1, detailed description thereof will be omitted. Finally, the shape of a liquid ejection unit was cut out from the substrate 2, electrical connection and the like were performed, and a liquid ejection head was manufactured. When the liquid ejection head was observed, a small amount of attached matter was confirmed in the vicinity of the ejection orifice 11. When the attached matter was analyzed, the same components as the dry film 6 were detected and it may be considered that the dry film remaining outside the region of the first surface 21 of the substrate 2 was detached and scattered to be the attached matter.

Comparative Example 2

In the present Comparative Example, since FIG. 2A to FIG. 2C are the same as in Example 1, detailed description thereof will be omitted.

Next, as illustrated in FIG. 2D, the support 5 and the dry film 6 were cut. The cutting was performed at a position 5 mm outward from the peripheral edge 21*a* of the first surface 21 of the substrate 2. A stainless steel cutter was used for cutting in an environment of 25° C.

Next, as illustrated in FIG. 2E, the support 5 was peeled from the dry film 6 in a 25° C. environment. Peeling was performed at an angle of 30° at 10 mm/sec. At this time, the remaining dry film was observed in the region which is approximately 20% of the periphery of the substrate outside the region of the first surface 21 of the substrate 2.

Since FIG. 2F to FIG. 2I are the same as in Example 1, detailed description thereof will be omitted. Finally, the shape of a liquid ejection unit was cut out from the substrate 2, electrical connection and the like were performed, and a liquid ejection head was manufactured. When the liquid ejection head was observed, a small amount of attached matter was confirmed in the vicinity of the ejection orifice 11. When the attached matter was analyzed, the same components as the dry film 6 were detected and it may be considered that the dry film remaining outside the region of the first surface 21 of the substrate 2 was detached and scattered to be the attached matter.

Comparative Example 3

In the present Comparative Example, since FIG. 2A to FIG. 2C are the same as in Example 1, detailed description thereof will be omitted.

Next, as illustrated in FIG. 2D, the support 5 and the dry film 6 were cut. The cutting was performed at a position 1 mm outward from the peripheral edge 21*a* of the first surface 21 of the substrate 2. A stainless steel cutter was used for cutting in an environment of 25° C.

Next, as illustrated in FIG. 2E, the support 5 was peeled from the dry film 6 in a 25° C. environment. Peeling was performed at an angle of 30° at 10 mm/sec. At this time, the remaining dry film was observed in the region corresponding to approximately 80% of the periphery of the substrate outside the region of the first surface 21 of the substrate 2.

Since FIG. 2F to FIG. 2I are the same as in Example 1, detailed description thereof will be omitted. Finally, the shape of a liquid ejection unit was cut out from the substrate 2, electrical connection and the like were performed, and a liquid ejection head was manufactured. When the liquid ejection head was observed, attached matter was confirmed in the vicinity of the ejection orifice 11. When the attached matter was analyzed, the same components as the dry film 6 were detected and it may be considered that the dry film remaining outside the region of the first surface 21 of the substrate 2 was detached and scattered to be the attached matter.

Comparative Example 4

In the present Comparative Example, since FIG. 2A to FIG. 2C are the same as in Example 1, detailed description thereof will be omitted.

Next, as illustrated in FIG. 2D, the support 5 and the dry film 6 were cut. The cutting was performed at a position 8 mm outward from the end portion of the substrate. A stainless steel cutter was used for cutting in an environment of 25° C.

Next, as illustrated in FIG. 2E, the support 5 was peeled from the dry film 6 in a 120° C. environment. Peeling was performed at an angle of 30° at 10 mm/sec. At this time, the remaining dry film was observed in the region which is approximately 10% of the periphery of the substrate outside the substrate surface region.

Since FIG. 2F to FIG. 2I are the same as in Example 1, detailed description thereof will be omitted. Finally, the shape of a liquid ejection unit was cut out from the substrate 2, electrical connection and the like were performed, and a liquid ejection head was manufactured. When the liquid ejection head was observed, a small amount of attached matter was confirmed in the vicinity of the ejection orifice 11. When the attached matter was analyzed, the same components as the dry film 6 were detected and it may be considered that the dry film remaining outside the region of the first surface 21 of the substrate 2 was detached and scattered to be the attached matter.

Comparative Example 5

In the present Comparative Example, since FIG. 2A to FIG. 2C are the same as in Example 1, detailed description thereof will be omitted.

Next, as illustrated in FIG. 2D, the support 5 and the dry film 6 were cut. The cutting was performed at a position 8 mm outward from the peripheral edge 21*a* of the first surface 21 of the substrate 2. A stainless steel cutter was used for cutting in an environment of 25° C.

Next, as illustrated in FIG. 2E, the support 5 was peeled from the dry film 6 in a 25° C. environment. Peeling was performed at an angle of 120° at 10 mm/sec. At this time, the remaining dry film was observed in the region which is approximately 10% of the periphery of the substrate outside the region of the first surface 21 of the substrate 2.

Since FIG. 2F to FIG. 2I are the same as in Example 1, detailed description thereof will be omitted. Finally, the shape of a liquid ejection unit was cut out from the substrate 2, electrical connection and the like were performed, and a liquid ejection head was manufactured. When the liquid ejection head was observed, a small amount of attached matter was confirmed in the vicinity of the ejection orifice 11. When the attached matter was analyzed, the same components as the dry film 6 were detected and it may be considered that the dry film remaining outside the region of the first surface 21 of the substrate 2 was detached and scattered to be the attached matter.

Comparative Example 6

In the present Comparative Example, since FIG. 2A to FIG. 2C are the same as in Example 1, detailed description thereof will be omitted.

Next, as illustrated in FIG. 2D, the support 5 and the dry film 6 were cut. The cutting was performed at a position 8 mm outward from the peripheral edge 21*a* of the first surface 21 of the substrate 2. A stainless steel cutter was used for cutting in an environment of 25° C.

Next, as illustrated in FIG. 2E, the support 5 was peeled from the dry film 6 in a 25° C. environment. Peeling was performed at an angle of 30° at 0.5 mm/sec. At this time, the remaining dry film was observed in the region which is approximately 10% of the periphery of the substrate outside the region of the first surface 21 of the substrate 2.

Since FIG. 2F to FIG. 2I are the same as in Example 1, detailed description thereof will be omitted. Finally, the shape of a liquid ejection unit was cut out from the substrate 2, electrical connection and the like were performed, and a liquid ejection head was manufactured. When the liquid ejection head was observed, a small amount of attached matter was confirmed in the vicinity of the ejection orifice 11. When the attached matter was analyzed, the same components as the dry film 6 were detected and it may be considered that the dry film remaining outside the region of the first surface 21 of the substrate 2 was detached and scattered to be the attached matter.

Example 3

First, as illustrated in FIG. 2A, the substrate 2 having the energy-generating element 3 formed of TaSiN on the first surface 21 side was prepared. A silicon (100) substrate is used as the substrate 2 and the substrate 2 has a protective film (not illustrated) formed of SiN. The supply port 4 is formed in the substrate 2 and the supply port 4 is opened in the first surface 21 of the substrate 2. The supply port 4 was formed by the Bosch process using the RIE (reactive ion etching) method.

Next, as illustrated in FIG. 2B, the support 5 and the dry film 6 (first dry film) supported by the support 5 were prepared.

A polyimide film having a thickness of 100 μm was used as the support 5 and no release treatment was performed on the dry film forming surface. The dry film 6 was formed by coating a solution in which an epoxy resin (manufactured by Dainippon Ink, trade name: N-695) and a photoacid generator (manufactured by San-Apro, trade name: CPI-210S) were dissolved in PGMEA on the dry film forming surface of the support 5, and thereafter drying the result at 100° C. in an oven.

Next, as illustrated in FIG. 2C, the dry film 6 supported by the support 5 is bonded and transferred to the first surface 21 of the substrate 2 on which the supply port 4 is formed, and a dry film layer which is a part of the flow path forming member 12 was formed. The bonding was performed by a roll type laminator (manufactured by Takatori Corp., trade name; VTM-200). The thickness of the dry film 6 after bonding was 5 μm.

Next, as illustrated in FIG. 2D, the support 5 and the dry film 6 were cut. The cutting was performed at a position 5 mm outward from the peripheral edge 21*a* of the first surface 21 of the substrate 2. A stainless steel cutter was used for cutting in an environment of 70° C.

Next, as illustrated in FIG. 2E, the support 5 was peeled from the dry film 6 in an environment of 70° C. Peeling was performed at an angle of 30° at 10 mm/sec. At this time, there was no remaining dry film outside the region of the first surface 21 of the substrate 2.

Next, as illustrated in FIG. 2F, the dry film 6 was exposed to light with an exposure wavelength of 365 nm at an exposure amount of 5000 J/m$^2$ using an exposure apparatus (manufactured by Canon Inc., trade name; FPA-3000i5 +). Thereafter, baking was performed at 50° C. for 5 minutes to form the pattern 7 to be a flow path.

Next, as illustrated in FIG. 2G, the photosensitive resin layer 8 to be a part of the flow path forming member 12 was formed by transferring a dry film (second dry film). The second dry film was manufactured by coating a coating solution in which an epoxy resin (manufactured by Japan Epoxy Resin, trade name 157S70) and a photoacid generator (manufactured by San Apro, trade name: LW-S1) were dissolved in PGMEA and which has a sensitivity different from that of the dry film 6 on a second support, and carrying out drying. The dry film was bonded to the processing surface formed of the flow path pattern 7 and the cured portion 6*c* using a roll type laminator. The thickness of the photosensitive resin layer 8 after bonding was 3 μm. Also here, at the time of cutting the support and the dry film, cutting was performed at a position 5 mm outward from the peripheral edge 21*a* of the first surface 21 of the substrate 2 and the support was peeled. At this time, there was no remaining dry film outside the region of the first surface 21 of the substrate 2. The pattern 9 to be the ejection orifice illustrated in FIG. 2H was formed by pattern exposure using an exposure apparatus (manufactured by Canon Inc., trade name; FPA-3000i5+). Thereafter, baking was performed at 90° C. for 5 minutes to form the pattern 9 to be the ejection orifice.

Next, as illustrated in FIG. 2I, by immersing in PGMEA, the pattern 7 which is the flow path and the pattern 9 which is the ejection orifice were developed to form the flow path 14 and the ejection orifice 11 of the liquid.

Finally, the shape of a liquid ejection unit was cut out from the substrate 2, electrical connection and the like were performed, and a liquid ejection head was manufactured. The liquid ejection head was observed to confirm that there were no defects.

Example 4

In the present Example, since FIG. 2A to FIG. 2C are the same as in Example 3, detailed description thereof will be omitted.

Next, as illustrated in FIG. 2D, the support 5 and the dry film 6 were cut. The cutting was performed at a position 2 mm outward from the peripheral edge 21*a* of the first surface 21 of the substrate 2. A stainless steel cutter was used for cutting in an environment of 70° C.

Next, as illustrated in FIG. 2E, the support 5 was peeled from the dry film 6 in an environment of 70° C. Peeling was performed at an angle of 30° at 10 mm/sec. At this time, there was no remaining dry film outside the region of the first surface 21 of the substrate 2.

Since FIG. 2F to FIG. 2I are the same as in Example 1, detailed description thereof will be omitted. Finally, the shape of a liquid ejection unit was cut out from the substrate 2, electrical connection and the like were performed, and a liquid ejection head was manufactured. The liquid ejection head was observed and it was confirmed that there were no defects.

Comparative Example 7

In the present Comparative Example, since FIG. 2A to FIG. 2C are the same as in Example 3, detailed description thereof will be omitted.

Next, as illustrated in FIG. 2D, the support 5 and the dry film 6 were cut. The cutting was performed at a position 1 mm outward from the peripheral edge 21*a* of the first surface 21 of the substrate 2. A stainless steel cutter was used for cutting in an environment of 70° C.

Next, as illustrated in FIG. 2E, the support 5 was peeled from the dry film 6 in an environment of 70° C. Peeling was performed at an angle of 30° at 10 mm/sec. At this time, the remaining dry film was observed in the region which is approximately 30% of the periphery of the substrate outside the region of the first surface 21 of the substrate 2.

Since FIG. 2F to FIG. 2I are the same as in Example 1, detailed description thereof will be omitted. Finally, the shape of a liquid ejection unit was cut out from the substrate 2, electrical connection and the like were performed, and a liquid ejection head was manufactured. When the liquid ejection head was observed, a small amount of attached matter was confirmed in the vicinity of the ejection orifice 11. When the attached matter was analyzed, the same components as the dry film 6 were detected and it may be considered that the dry film remaining outside the region of the first surface 21 of the substrate 2 was detached and scattered to be the attached matter.

Comparative Example 8

In the present Comparative Example, since FIG. 2A to FIG. 2C are the same as in Example 3, detailed description thereof will be omitted.

Next, as illustrated in FIG. 2D, the support 5 and the dry film 6 were cut. The cutting was performed at a position 0.5 mm outward from the peripheral edge 21*a* of the first surface 21 of the substrate 2. A stainless steel cutter was used for cutting in an environment of 70° C.

Next, as illustrated in FIG. 2E, the support 5 was peeled from the dry film 6 in an environment of 70° C. Peeling was performed at an angle of 30° at 10 mm/sec. At this time, the remaining dry film was observed in the region which is approximately 80% of the periphery of the substrate outside the region of the first surface 21 of the substrate 2.

Since FIG. 2F to FIG. 2I are the same as in Example 1, detailed description thereof will be omitted. Finally, the shape of a liquid ejection unit was cut out from the substrate 2, electrical connection and the like were performed, and a liquid ejection head was manufactured. When the liquid ejection head was observed, attached matter was confirmed in the vicinity of the ejection orifice 11. When the attached matter was analyzed, the same components as the dry film 6 were detected and it may be considered that the dry film remaining outside the region of the first surface 21 of the substrate 2 was detached and scattered to be the attached matter.

TABLE 1

| | | Support<br>PET film (Thickness: 100 μm)<br>Dry film<br>Resin component: Epoxy resin (thickness: 15 μm) | | | | | | | |
|---|---|---|---|---|---|---|---|---|---|
| | | Comparative Example 3 | Comparative Example 2 | Comparative Example 1 | Example 2 | Example 1 | Comparative Example 4 | Comparative Example 5 | Comparative Example 6 |
| Cutting position (μm) | | 1 | 5 | 7 | 8 | 10 | 8 | ← | ← |
| Peeling temperature (° C.) | | 25 | ← | ← | ← | ← | 120 | 25 | ← |
| Peeling angle (°) | | 30 | ← | ← | ← | ← | ← | 120 | 30 |
| Peeling speed (mm/second) | | 10 | ← | ← | ← | ← | ← | ← | 0.5 |
| Dry film remaining | Evaluation | C | B | B | A | A | B | B | B |
| | Remaining % | 80% | 20% | 10% | 0% | 0% | 10% | 10% | 10% |

TABLE 2

| | | Support<br>Polyimide film (thickness: 100 μm)<br>Dry film<br>Resin component: Epoxy resin (thickness: 5 μm) | | | |
|---|---|---|---|---|---|
| | | Comparative Example 8 | Comparative Example 7 | Example 4 | Example 3 |
| Cutting position (μm) | | 0.5 | 1 | 2 | 5 |
| Peeling temperature (° C.) | | 70 | ← | ← | ← |
| Peeling angle (°) | | 30 | ← | ← | ← |
| Peeling speed (mm/second) | | 10 | ← | ← | ← |
| Dry film remaining | Evaluation | C | B | A | A |
| | Remaining % | 80% | 30% | 0% | 0% |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-180584, filed Sep. 26, 2018, which is hereby incorporated by reference herein in its entirety.

What is claimed is:

1. A method of manufacturing a substrate with a resin layer, including transferring a dry film for forming a structure from a support to a substrate, the method comprising:

bonding the dry film supported by the support on a processing surface of the substrate, the bonding including forming a projection part, the projection part being a portion of peripheral edges of the dry film and the support which protrude further outside than a peripheral edge of the processing surface;

cutting the projection part at a cutting position between an outer edge of the projection part and the peripheral edge of the processing surface and leaving a portion further inside than the cutting position as a remaining projection part; and peeling the support from the substrate with the remaining projection part as a start position, separating the dry film into a first portion of the remaining projection part supported by the support and a second portion bonded to the processing surface, removing the first portion from the substrate along with the support, and leaving the second portion on the processing surface, the second portion forming the structure, wherein the cutting position of the projection part is a position where it is possible to separate the first portion and the second portion of the dry film.

2. The method of manufacturing a substrate with a resin layer according to claim 1, wherein the cutting position is set based on interfacial holding force of an adhesion surface between the support and the dry film in the remaining projection part and aggregating force of the dry film bonded to the processing surface.

3. The method of manufacturing a substrate with a resin layer according to claim 2, wherein the cutting position is set such that the interfacial holding force of the adhesion surface between the support and the dry film in the remaining projection part is larger than the aggregating force of the dry film bonded to the processing surface.

4. The method of manufacturing a substrate with a resin layer according to claim 1, wherein, when a position of the peripheral edge of the processing surface is assumed to be 0 mm, a distance (X) between the cutting position and the peripheral edge of the processing surface in a peeling direction of the support from the substrate satisfies 0 mm<X<15 mm.

5. The method of manufacturing a substrate with a resin layer according to claim 1, wherein the peeling of the support from the substrate is performed at a temperature of 10° C. to 100° C.

6. The method of manufacturing a substrate with a resin layer according to claim 1, further comprising:

peeling the support linearly from a first end portion of the substrate in a direction toward a second end portion at a position corresponding to the first end portion.

7. The method of manufacturing a substrate with a resin layer according to claim 1, wherein a peeling speed of the support from the substrate is 1 mm/second or more.

8. The method of manufacturing a substrate with a resin layer according to claim 1, wherein the dry film is formed of a photosensitive resin composition.

9. The method of manufacturing a substrate with a resin layer according to claim 1, wherein the support is peeled at an angle of the support with respect to the processing surface in a range of 30° to 90°.

10. The method of manufacturing a substrate with a resin layer according to claim 1, wherein the structure is at least a part of a flow path forming member of a liquid ejection head.

11. A method of manufacturing a liquid ejection head, including transferring a dry film for forming a partial structure of a liquid ejection head from a support to a substrate, the method comprising:

bonding the dry film supported by the support on a processing surface of the substrate, the bonding including forming a projection part, the projection part being a portion of a peripheral edge of the dry film and the support which protrude further outside than a peripheral edge of the processing surface;

cutting the projection part at a cutting position between an outer edge of the projection part and the peripheral edge of the processing surface and leaving a portion further inside than the cutting position as a remaining projection part; and peeling the support from the substrate with the remaining projection part as a start position, separating the dry film into a first portion of the remaining projection part supported by the support and a second portion bonded to the processing surface, removing the first portion from the substrate along with the support, and leaving the second portion on the processing surface, the second portion forming the partial structure of a liquid ejection head, wherein the cutting position of the projection part is a position where it is possible to separate the first portion and the second portion of the dry film.

12. The method of manufacturing a liquid ejection head according to claim 11, wherein the cutting position is set based on interfacial holding force of an adhesion surface between the support and the dry film in the remaining projection part and aggregating force of the dry film bonded to the processing surface.

13. The method of manufacturing a liquid ejection head according to claim 12, wherein the cutting position is set such that the interfacial holding force of the adhesion surface between the support and the dry film in the remaining projection part is larger than the aggregating force of the dry film bonded to the processing surface.

14. The method of manufacturing a liquid ejection head according to claim 11, wherein, when a position of a peripheral edge of the processing surface is assumed to be 0 mm, a distance (X) between the cutting position and the peripheral edge of the processing surface in a peeling direction of the support from the substrate satisfies 0 mm<X<15 mm.

15. The method of manufacturing a liquid ejection head according to claim 11, wherein the peeling of the support from the substrate is performed at a temperature of 10° C. to 100° C.

16. The method of manufacturing a liquid ejection head according to claim 11, further comprising:

peeling the support linearly from a first end portion of the substrate in a direction toward a second end portion at a position corresponding to the first end portion.

17. The method of manufacturing a liquid ejection head according to claim 11, wherein a peeling speed of the support from the substrate is 1 mm/second or more.

18. The method of manufacturing a liquid ejection head according to claim 11, wherein the dry film is formed of a photosensitive resin composition.

19. The method of manufacturing a liquid ejection head according to claim 11, wherein the support is peeled at an angle of the support with respect to the processing surface in a range of 30° to 90°.

20. The method of manufacturing a liquid ejection head according to claim 11, further comprising:

forming a plurality of liquid ejection units through transferring the dry film to the processing surface using the substrate as a common substrate; and dividing each liquid ejection unit, wherein the partial structure is at least a part of a flow path forming member.

* * * * *